US007395642B2

(12) United States Patent
Plourde et al.

(10) Patent No.: US 7,395,642 B2
(45) Date of Patent: Jul. 8, 2008

(54) METHOD OF MANUFACTURING PACKAGES INCORPORATING EASY-OPEN STRIPS

(75) Inventors: Eric Paul Plourde, Homewood, IL (US); Robert E. Hogan, Burr Ridge, IL (US)

(73) Assignee: Illinois Tool Works Inc., Glenview, IL (US)

( * ) Notice: Subject to any disclaimer, the term of this patent is extended or adjusted under 35 U.S.C. 154(b) by 683 days.

(21) Appl. No.: 10/913,719

(22) Filed: Aug. 5, 2004

(65) Prior Publication Data

US 2005/0008268 A1 Jan. 13, 2005

Related U.S. Application Data

(63) Continuation-in-part of application No. 10/151,388, filed on May 20, 2002, now abandoned.

(51) Int. Cl.
*B65B 61/18* (2006.01)
*B65B 9/20* (2006.01)

(52) U.S. Cl. ..... 53/412; 53/451; 53/133.3; 53/551

(58) Field of Classification Search ..... 53/133.4
See application file for complete search history.

(56) References Cited

U.S. PATENT DOCUMENTS

| | | | | |
|---|---|---|---|---|
| 3,266,965 | A | 8/1966 | Spees | |
| 3,687,358 | A | 8/1972 | Wink et al. | |
| 4,532,754 | A * | 8/1985 | Hokanson | 53/451 |
| 4,846,585 | A | 7/1989 | Boeckmann et al. | |
| 4,894,975 | A * | 1/1990 | Ausnit | 53/412 |
| 5,023,122 | A * | 6/1991 | Boeckmann et al. | 428/43 |
| RE33,674 | E | 8/1991 | Uramoto | |
| 5,054,618 | A | 10/1991 | Kim | |
| 5,092,684 | A * | 3/1992 | Weeks | 383/61.2 |
| 5,121,997 | A * | 6/1992 | La Pierre et al. | 383/203 |
| 5,186,543 | A * | 2/1993 | Cochran | 383/203 |
| 5,425,216 | A * | 6/1995 | Ausnit | 53/410 |
| 5,561,966 | A * | 10/1996 | English | 53/412 |
| 5,609,420 | A | 3/1997 | Palmisano | |
| 5,660,479 | A | 8/1997 | May et al. | |
| 5,826,401 | A * | 10/1998 | Bois | 53/412 |
| 5,875,611 | A | 3/1999 | Plourde | |
| 5,884,452 | A * | 3/1999 | Bois | 53/412 |
| 6,047,521 | A * | 4/2000 | Terminella et al. | 53/133.4 |
| 6,327,837 | B1 * | 12/2001 | Van Erden | 53/412 |

(Continued)

FOREIGN PATENT DOCUMENTS

| | | |
|---|---|---|
| DE | 2258965 | 12/1972 |

*Primary Examiner*—Stephen F. Gerrity
(74) *Attorney, Agent, or Firm*—Ostrager Chong Flaherty & Broitman P.C.

(57) ABSTRACT

A method of manufacture comprising the following steps: (a) guiding a web material in a machine direction through a vertical form-fill-seal (VFFS) machine with a portion of the web material being wrapped around a tube; (b) joining first and second portions of a closure tape to first and second fin portions of the web material that do not form part of the portion of the web material that is wrapped around the tube, the closure tape being rupturable and not reclosable; (c) cross sealing the web material at a location downstream from the tube; and (d) dropping product through the tube and onto the most recently formed cross seal.

23 Claims, 6 Drawing Sheets

U.S. PATENT DOCUMENTS 6,350,340 B1 * 2/2002 Johnson ..... 156/252
6,360,513 B1 * 3/2002 Strand et al. ..... 53/412
6,461,044 B1 * 10/2002 Anderson ..... 383/211
6,609,353 B1 * 8/2003 McMahon et al. ..... 53/412
6,675,558 B2 * 1/2004 Kinigakis et al. ..... 53/412
6,691,491 B2 * 2/2004 Terminella et al. ..... 53/133.4
2003/0215165 A1 11/2003 Hogan et al. ..... 53/412

* cited by examiner

METHOD OF MANUFACTURING PACKAGES INCORPORATING EASY-OPEN STRIPS

RELATED PATENT APPLICATION

This application is a continuation-in-part of and claims priority from U.S. patent application Ser. No. 10/151,388, filed May 20, 2002, now abandoned.

BACKGROUND OF THE INVENTION

The present invention relates to easily openable closure tapes for bags, and more particularly to perforated strips useful as closure tapes for bags.

Bulk consumer items (e.g., potting soil, seed, and animal feed as well as food products for service applications) are often packaged in large bags (e.g., pouches or satchels) for sale to the public. The weight of these bulk items often necessitates that the material for the bag be durable and tear-resistant. Typically, bulk item bags are made of a tear-resistant plastic, a tear-resistant paper-based material, or some combination of the two. However, opening such bulk item bags without the use of cutting instruments is often difficult due to the tear resistance of the bag material.

A solution to the foregoing problem was posed in U.S. Patent Application Publication No. 2003/0215165 entitled "Easy-Open Strip and Bags Incorporating the Same". That application discloses an easy-open closure tape for a bag, which includes a base web, a frangible layer, and a tear bead. The base web has a pair of longitudinal edges with a pair of perforated tear lines running generally parallel to the longitudinal edges and substantially equidistant from the longitudinal edges. The frangible layer is attached to one side of the base web and is positioned over the perforated tear lines to obstruct the perforations on one side. The tear bead is attached to the frangible layer on the side opposite from the base web and is positioned generally centrally between the respective locations of the perforated tear lines. Preferably, the base web is formed from a material such as a thermoplastic polymer, a paper-based material, other multi-layer webs used in the packaging industry or a combination thereof. The frangible layer serves to seal the perforations, thereby keeping out small particles and insects and preventing small particles within the packages from leaking out. The frangible layer also aids in keeping moisture in or out.

There is a need for efficient and inexpensive methods of manufacturing packages having easily opened closure strips. There is also a need for alternative designs for easily opened closure strips.

BRIEF DESCRIPTION OF THE INVENTION

The present invention is directed to various designs for easily opened closure strips and to methods of manufacturing bags having easily opened closure strips.

One aspect of the present invention is a method of manufacture comprising the following steps: (a) guiding a web material in a machine direction through a vertical form-fill-seal (VFFS) machine with a portion of the web material being wrapped around a tube; (b) joining first and second portions of a closure tape to first and second fin portions of the web material that do not form part of the portion of the web material that is wrapped around the tube, the closure tape being rupturable and not reclosable; (c) cross sealing the web material at a location downstream from the tube; and (d) dropping product through the tube and onto the most recently formed cross seal.

Another aspect of the present invention is a method of automatically manufacturing closed bags, comprising the following steps: (a) intermittently advancing a web along a pathway that partly encircles a tube having an axis, whereby after each advancement, a portion of the web is wrapped around a portion of the tube, while first and second fin portions of the web extend generally radially outward from the tube; (b) during each dwell time, joining a respective section of a closure tape to the first and second fin portions of the web while the portion of the web is wrapped around the portion of the tube, thereby forming a closure-web assembly; (c) during each dwell time and after step (b) has been performed, cross sealing the web in a transverse region at an elevation below an outlet end of the tube; (d) during each dwell time, dropping product down the tube and onto the most recently cross-sealed portion of the web; and (e) during each dwell time, cutting the closure-web assembly along a transverse line that intersects a respective cross-sealed region, thereby severing a finished bag from the closure-web assembly.

A further aspect of the present invention is a package comprising a receptacle having a mouth closed by a closure strip along a first side, the receptacle comprising first and second walls joined to each other along second and third sides and connected by a fold along a fourth side opposite the first side, the closure strip comprising a folded web having a centerline, the folded web comprising first and second portions on opposite sides of a fold in the folded web respectively joined to a portion of the first wall in a first band-shaped zone and to a portion of the second wall in a second band-shaped zone along the mouth, and the folded web further comprising first and second scorelines at the same elevation above the mouth on opposite sides of the fold.

Yet another aspect of the present invention is a package comprising a receptacle having a mouth closed by a closure strip along a first side, the receptacle comprising first and second walls joined to each other along second and third sides and connected by a fold along a fourth side opposite the first side, the closure strip comprising a folded web having a centerline, the folded web comprising first and second portions on opposite sides of a fold in the folded web respectively joined to a portion of the first wall in a first band-shaped zone and to a portion of the second wall in a second band-shaped zone along the mouth, and the folded web further comprising first and second perforated tear lines at the same elevation above the mouth on opposite sides of the fold, the closure strip further comprising a peel seal joined to the first and second portions of the folded web.

Another aspect of the present invention is a package comprising a receptacle having a mouth closed by a closure strip along a first side, the receptacle comprising first and second walls joined to each other along second and third sides and connected by a fold along a fourth side opposite the first side, the closure strip comprising a folded web having a centerline, the folded web comprising first and second portions on opposite sides of a fold in the folded web respectively joined to a portion of the first wall in a first band-shaped zone and to a portion of the second wall in a second band-shaped zone along the mouth, and third and fourth portions on opposite sides of the fold that project upward above the mouth and outside the receptacle, wherein the fold is disposed below the first and second band-shaped zones and inside the receptacle.

A further aspect of the present invention is a package comprising a receptacle having a mouth closed by a closure strip along a first side, the receptacle comprising first and second walls joined to each other along second and third sides and connected by a fold along a fourth side opposite the first side, the closure strip comprising first and second webs respectively joined to a portion of the first wall in a first band-shaped zone and to a portion of the second wall in a second band-shaped zone along the mouth, and a peel seal joined to the first and second webs such that the peel seal seals an interior volume of the receptacle.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
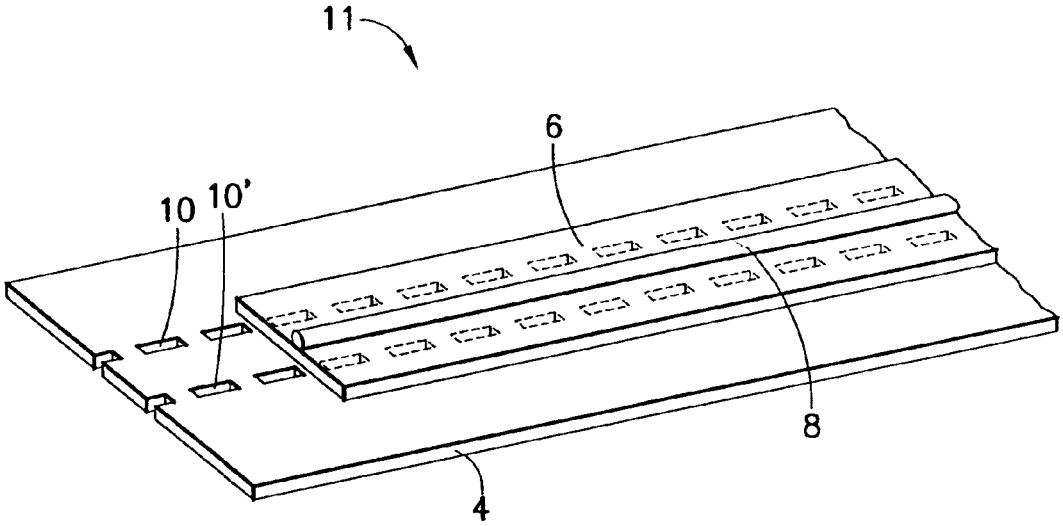
FIG. 1 PRIOR ART
FIG. 1 is a drawing showing an isometric view, with portions broken away, of an easy-open closure tape in accordance with known prior art.

FIG. 1 is an isometric view of an easy-open closure tape disclosed in U.S. Patent Application Publication No. 2003/0215165. This closure tape 11 comprises a base web 4 formed from a length of a thermoplastic polymer such as polyethylene, a length of paper-based material or a combination of the two materials (e.g., a laminate). Preferably, the thermoplastic polymer and paper-based material are not frangible. As used herein, the term "frangible" means that the material is easily broken or ruptured. Base web 4 has a pair of mutually parallel longitudinal edges and a pair of perforated tear lines (i.e., lines of spaced perforations) 10, 10' running generally parallel to the longitudinal edges. Perforated tear lines 10, 10' are located substantially equidistant from the longitudinal edges and the perforations are spaced sufficiently close so that the tear lines will rupture upon the application of a tearing force to the tear lines.

Attached to one side of base web 4 is a layer 6 made of a frangible thermoplastic film. Frangible layer 6 is positioned on one side of the base web 4 so as to obstruct (or seal) the perforations of tear lines 10, 10'. An example of a thermoplastic polymer suitable for use as the frangible layer 6 is ethylene vinyl acetate (EVA). Frangible layer 6 is attached to the base web 4 by any conventional technique, such as heat sealing, adhesive bonding, extrusion coating, etc. The method of choice for attaching the two layers will be partially dependent on the choice of material for base web 4. For example, if base web 4 is a thermoplastic polymer, frangible layer 6 can be adhered via heating sealing or via the use of a tie layer. Likewise, if base web 4 is a paper-based material, frangible layer 6 can be adhered thereto with an adhesive.

Frangible layer 6 has attached thereto a tear bead 8 on the side opposite from the base web 4. The tear bead 8 may be made of a generally tear-resistant material (i.e., non-frangible), such as a cloth string or plastic extrusion. The tear resistance of the tear bead 8 is greater than that of either the base web material 4 or the wall material of the bag incorporating the easy-open closure tape 11. Preferably, tear bead 8 is formed from a tear-resistant thermoplastic polymer such as polypropylene or low- or high-density polyethylene and may be attached by heat sealing, adhesive bonding or any other appropriate technique known in the art. The tear bead 8 is centrally located on frangible layer 6 between the respective positions of perforated tear lines 10, 10' to substantially equalize the tearing force applied to tear lines 10, 10' as tear bead 8 is pulled away from the bag.

Figure 2:
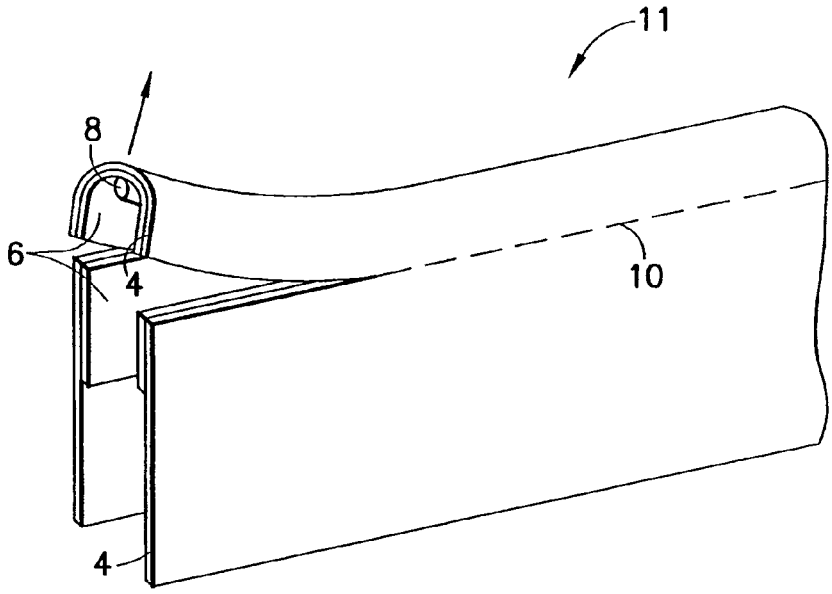
FIG. 2 PRIOR ART
FIG. 2 is a drawing showing an isometric view of the easy-open closure tape of FIG. 1 in a folded and partially opened state.

FIG. 2 is an isometric view of the easy-open closure tape 11 in a folded and partially open (i.e., torn) state. Closure tape 11 is folded at a location between and along the same direction as perforated tear lines 10, 10' so as to position frangible layer 6 and tear bead 8 within the interior of the folded closure tape 11, so that tear lines 10, 10' are obstructed on the interior side of closure tape 11. As shown in FIG. 2, the top of closure tape 11 is removed by tearing along perforated tear lines 10, 10' (10' not shown in FIG. 2) by pulling along tear bead 8.

Figure 3:
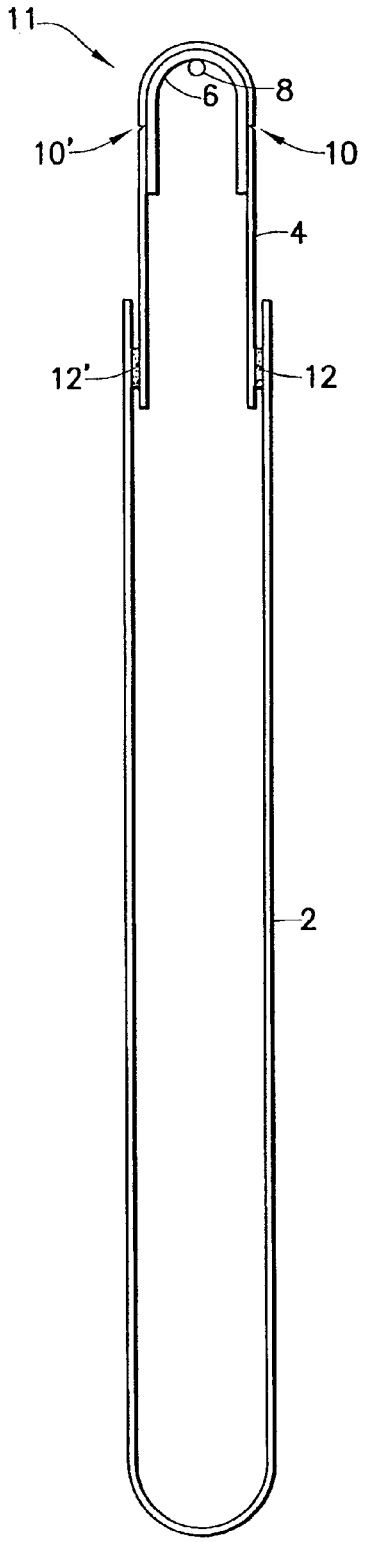
FIGS. 3 and 4 are drawings showing cross-sectional views of respective packages incorporating the easy-open closure tape depicted in FIG. 1.
Figure 4:
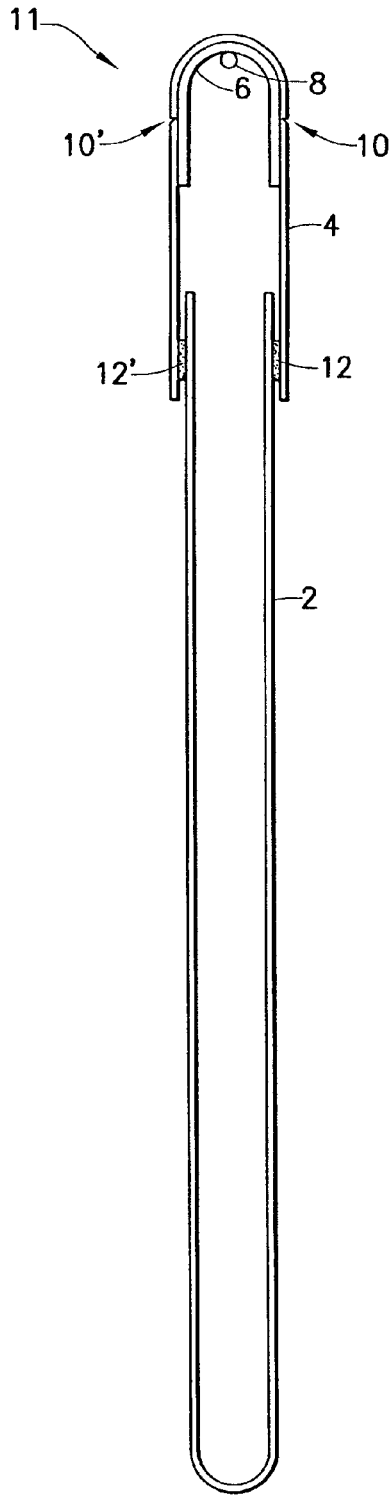

FIGS. 3 and 4 are cross-sectional views of respective packages incorporating a folded easy-open closure tape 11 of the type depicted in FIG. 2. As shown in FIG. 3, marginal portions of base web 4 are placed between marginal portions of a folded web 2. Within the zone of overlap, opposing portions of base web 4 are joined to opposing portions of the folded web 2 in respective band-shaped zones of joinder 12 and 12'. The zones of joinder 12 and 12' can be formed by any conventional technique, such as heat sealing, adhesive, bonding strip, tie layer, ultrasonics, etc., dependent on the type of materials used for web 2 and base web 4. The closure tape 11 is folded in a position between and in the same direction as perforated tear lines 10, 10' so that frangible layer 6 and tear bead 8 face the interior of the package. To facilitate opening of closure tape 11, the zones of joinder 12 and 12' are located below and do not overlap or cover the perforated tear lines 10, 10'. The package depicted in FIG. 4 differs from that depicted in FIG. 3 only in that the marginal portions of folded web 2 are placed between the marginal portions of base web 4, instead of vice versa.

Figure 5:
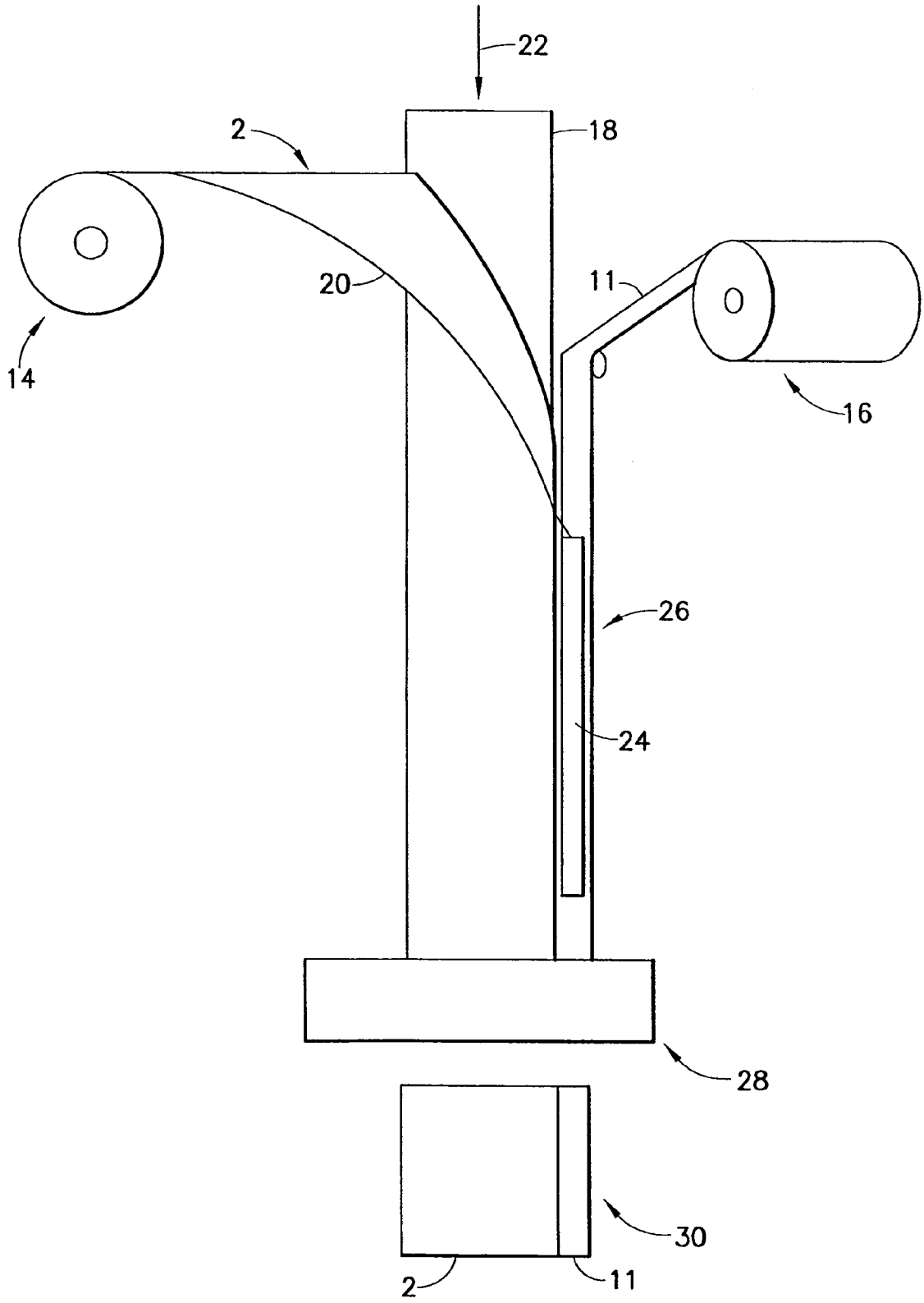
FIG. 5 is a drawing showing an elevational view of a VFFS machine for making easy-open packages using easy-open closure tape in accordance with one embodiment of the present invention.

FIG. 5 shows packages with easy-open closures being manufactured on a VFFS machine. A web 2 of packaging film is fed from a continuous supply roll 14 into the VFFS machine and wrapped around a forming collar 20 and around a filling tube 18 to bring the mutually parallel edges of the film web 2 together to form a tube. The film passes through a generally circular gap (not seen in FIG. 5) between the forming collar 20 and the top of the filling tube 18 in a well-known manner. The marginal portions of the web 2 do not lie against the outer surface of the fill tube, and instead are guided into mutually confronting vertical positions by guiding means (not shown in FIG. 5). The filling tube 18 has an upper funnel end through which product is discharged to fall downwardly into individual packages, which downward movement of product is indicated by arrow 22 in FIG. 5.

Figure 6:
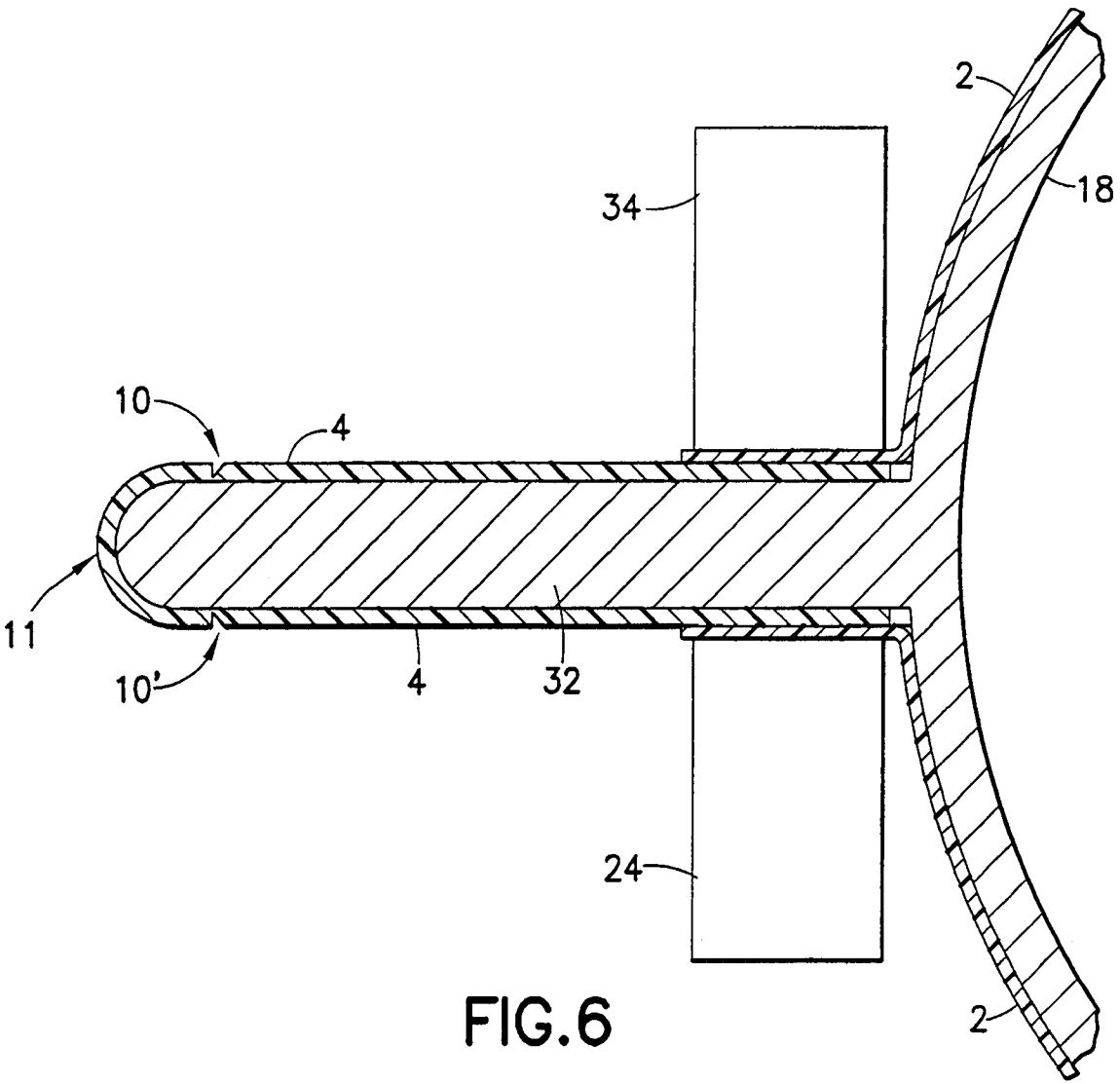
FIG. 6 is a drawing showing a fragmentary view of apparatus for joining an easy-open closure tape to a web of packaging film wrapped around a fill tube of the VFFS machine depicted in FIG. 5.

Still referring to FIG. 5, at the same time that the film web 2 is being fed, an easyopen closure tape 11 is fed from a continuous coil on a supply reel or spool 16. In accordance with one embodiment of the invention, the closure tape is guided downwardly by a guide member in the form of a separator plate 32 (shown in FIG. 6) disposed between the mutually confronting marginal portions (i.e., fins) of the film web 2. The separator plate 32 is rounded at its distal edge and is supported on the filling tube 18 or integrally formed therewith, as depicted in FIG. 6. For the sake of clarity in the drawing, the tear bead and sealing stripe of the easy-open closure tape are not shown in FIG. 6. The guide separator plate 32 is configured so that the marginal portions of base web 4 are placed in mutually confronting relationship. The guiding means for the web 2 of packaging film guide the fins of web 2 to positions outside and overlapping with the marginal portions of the base web 4 of the easy-open closure tape 11. The zones of overlap on opposing sides of the separator plate 32 pass through respective gaps between the separator plate and a pair of mutually opposing vertical seal bars 24 and 34. Within the zone of overlap, opposing portions of base web 4 are joined to opposing portions of the fins of web 2 in respective band-shaped zones of joinder (not shown in FIG. 6, but see items 12 and 12' in FIG. 3) when the vertical sealing bars 24 and 34 are heated and placed in their extended positions. In their extended positions, the heated sealing bars soften or melt the thermoplastic material of one or both webs 2 and 4, following which the softened or molten material fuses upon cooling to form the heat seals 12 and 12 'seen in FIG. 3. Alternatively, to manufacture packages of the type shown in FIG. 4 (i.e., the marginal portions of the closure tape disposed outside the fins of the web of packaging film) additional guiding means must be provided to place the marginal portions of the base web 4 of the closure tape 11 outside the fins of web 2.

In one embodiment, the film is advanced by being pulled down intermittently in increments of advancement equal to the width of a package to be formed. The film web 2 is pulled downwardly by cross-sealing bars 28, only one of which is shown in FIG. 5. The sealing bars are first brought together against a portion of the tubular film at a location where the film portion has descended below the lower end of the filling tube 18 in order to form a cross seal that joins mutually opposing band-shaped portions of the film, closing the film tube to form a pocket so that as product is dropped through the filling tube 18, that product is retained within the pocket. This transverse zone of joinder is later cut to provide a lagging side seam for one package and a leading side seam for another package. Essentially simultaneously with the sealing by the sealing bars, a cutting knife (not shown) is moved across the film to sever an individual previously filled package 30 from the work in process. The cross-sealing bars will again be brought together and then moved vertically downwardly to draw the film web 2 downwardly, thereby forming the next package around the filling tube 18.

In accordance with another embodiment, the film is pulled downwardly by drive belts (not shown) that press against the web along the sides of the fill tube to drive the web.

The finished filled package comprises a receptacle having an easy-open closure tape 11 across its mouth. The receptacle comprises generally rectangular front and rear walls that are sealed together at the sides. To gain access to the contents of the filled package, the user must tear off the top of the base web 4, as depicted in FIG. 2. To facilitate tearing off the top portion of the base web 4, the web is provided with a pair of lines of spaced perforations 10 and 10' running the length of the web. Furthermore, each line of perforations is capped by a respective sealing stripe 6 (see FIG. 1), as taught in U.S. Pat. No. 5,063,639. The sealing stripe effectively seals the perforations while still leaving the line of weakened tear resistance provided by the perforations.

The configuration of the means for guiding the easy-open closure tape into position adjacent the fins of the packaging film wrapped around the filling tube will naturally depend on the configuration of the closure tape. The present invention, in addition to be directed to methods of manufacture, is directed to designs for easy-open closure tape. Various embodiments of easy-open closure tape are shown in FIGS. 7-14. In each case, the sides of the closure tape are shown joined to the inside of the marginal portions of the film web 2. For the embodiments depicted in FIGS. 7-14, the sides of the closure tape could alternatively be joined to the outside of the marginal portions of the web. Also, in each case the closure tape is joined to the receptacle by heat seals 12 and 12', but other conventional methods of joinder can be employed, as previously described.

Figure 7:
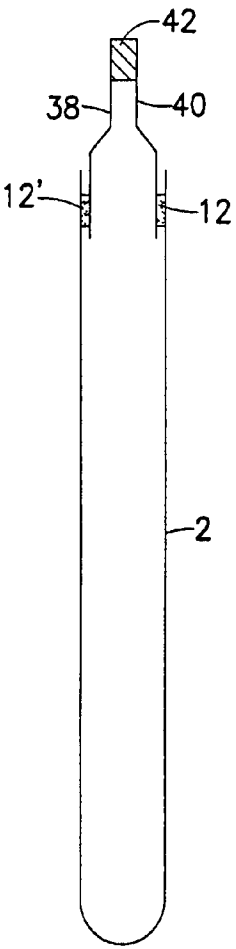
Figure 14:
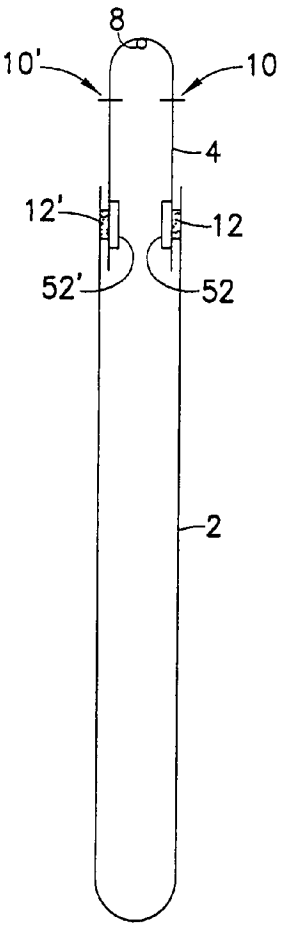

In accordance with one embodiment of the invention depicted in FIG. 7, the closure tape comprises a pair of webs 38 and 40 joined at or near their distal ends to a peelable or delamination-type seal 42, and joined at or near their proximal ends to respective sides of the receptacle, i.e., respective portions of film web 2. The seal 42 is designed to enable pinch grip opening of the package, i.e., the consumer can pull the two sides of the package apart to cause the peel seal material to separate from one of the webs 38 or 40, or to cause the peel seal material to rupture, or to cause two layers of a delamination-type seal to separate from each other.

Figure 8:
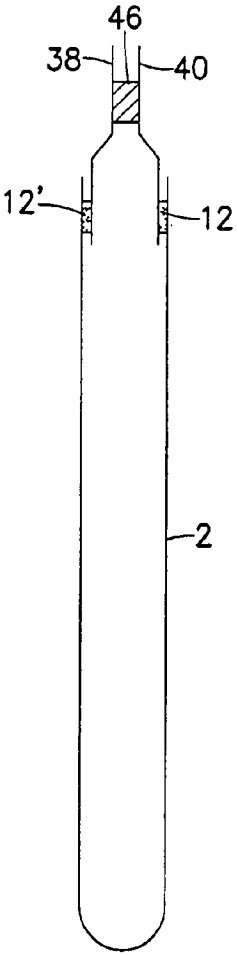

In accordance with another embodiment of the invention depicted in FIG. 8, the closure tape comprises a pair of webs 38 and 40 joined to a peelable seal 46, and joined at or near their proximal ends to respective sides of the receptacle, i.e., respective portions of film web 2. The peelable seal 46 is located sufficiently far from the distal ends of the webs 38 and 40 that the marginal portions of the webs 38 and 40 can serve as pull flanges for opening the closure. The peelable seal may be of the adhesive, cohesive or heat fused variety. In the case of adhesive material, a layer of adhesive material is joined to one of the webs 38 and 40 and adhered to the other. In the case of cohesive material, respective layers of cohesive material are joined to webs 38 and 40 and cohered to each other.

Figure 9:
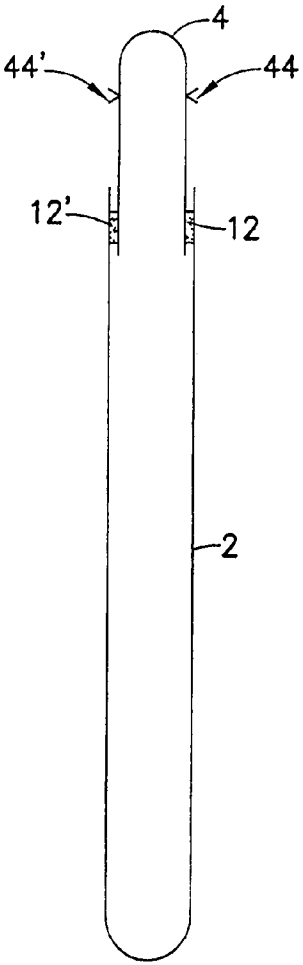

In accordance with a further embodiment of the invention depicted in FIG. 9, the closure tape comprises a folded base web 4 with two scorelines 44 and 44' on opposite sides of the folded base web 4 at approximately the same elevation. These scorelines (indicated by carets in FIG. 9) serves as lines of weakened tear resistance, allowing the top of the closure to be torn away. Optionally, a tear bead can be joined to the peak of the folded web 4 on the inside thereof.

Figure 10:
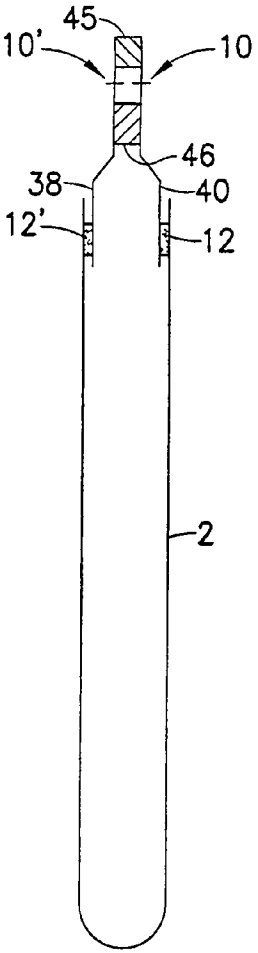
FIGS. 7 through 14 are drawings showing cross-sectional views of various alternative designs for a package having an easy-open closure in accordance with respective alternative embodiments of the present invention.

The embodiment depicted in FIG. 10 is similar to the embodiment shown in FIG. 8, except that a permanent seal 45 joins the marginal portions of the webs 38 and 40 together at their distal ends. A peelable seal 46 joins the webs 38 and 40 in a band-shaped region that extends parallel to permanent seal 45. Between the permanent seal 45 and a peelable seal 46, the webs 38 and 40 are not joined together. Respective perforated tear lines 10 and 10' (or line of weakened tear resistance) are disposed in the respective webs 38 and 40 at the same elevation within the aforementioned region between the permanent and peelable seals. The tear lines 10 and 10' facilitate tearing off of the top of the closure strip, including the permanent seal 45.

Figure 11:
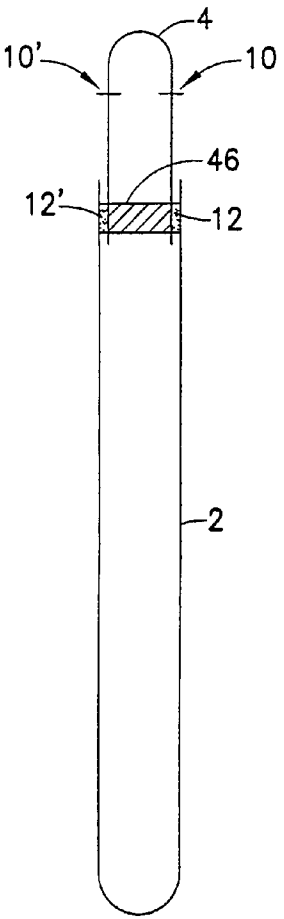

In accordance with another embodiment of the invention depicted in FIG. 11, the closure tape comprises a folded base web 4 having a peelable seal 46 joined to mutually opposing portions of web 4 that are, in turn, joined to the web 2 at zones of joinder 12 and 12'. Again perforated tear lines 10 and 10' are provided at an elevation above the peel seal to facilitate tearing off of the top (i.e., folded) portion of the folded web 4. Optionally, a tear bead can be joined to the peak of the folded web 4 on the inside thereof. During manufacture of this embodiment, the peelable seal 46 is heat activated when the closure tape is joined in zones 12 and 12' to opposing portions of the receptacle.

Figure 12:
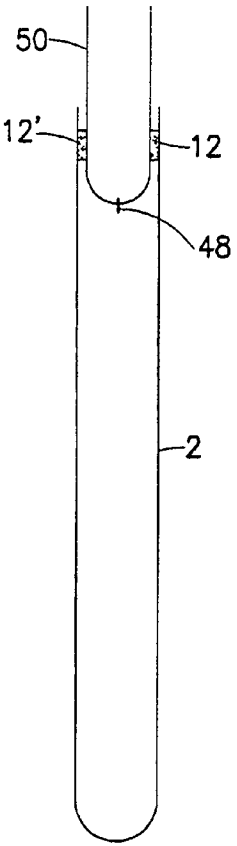

FIG. 12 shows an embodiment wherein a folded web 50 is inverted and then joined to the receptacle in zones 12 and 12'. The profile of the folded web may be generally U-shaped (as shown in FIG. 12) or V-shaped. The web 50 is provided with a line of weakened tear resistance 48 formed along a centerline at the bottom of the fold (or in the case of a V shape, at the cusp). The distal portions of the folded web 50 serve as pull flanges that the consumer can pull apart to cause the line of weakness 48 to rupture. The line of weakness 48 may take the form of a line made by laser scoring or a line of spaced perforations capped by a sealing stripe. In accordance with a further variation, the distal portions of web 50 can be joined together at a permanent seal, while perforated tear lines are disposed at an elevation intermediate the distal portions of the web 50 and the permanent seals 12 and 12'. The tear lines facilitate tearing off of the distal portions of the web 50.

Figure 13:
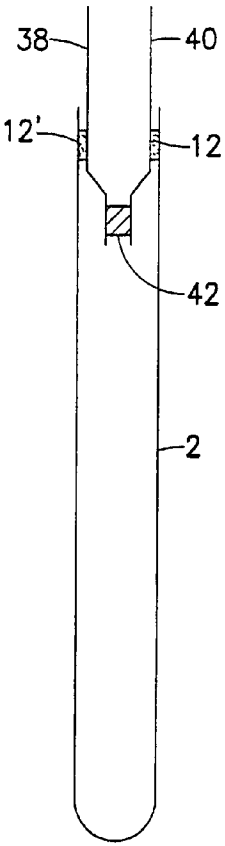

In accordance with yet another embodiment of the invention depicted in FIG. 13, the closure tape comprises a pair of webs 38 and 40 having intermediate portions respectively joined in zones 12 and 12' to confronting portions of web 2 near the mouth of the receptacle formed by web 2. The ends of webs 38 and 40 that are disposed inside the receptacle are respectively joined to opposite sides of a peelable or delamination-type seal 42. The distal ends of webs 38 and 40 that are disposed outside the receptacle can be used as pull flanges to rupture the seal 42. In one variation, the webs 38 and 40 can be replaced by a folded web with perforated tear lines similar to the structure seen in FIG. 11. In another variation, the distal portions of webs 38 and 40 can be joined while perforated tear lines are disposed at an elevation below the joined distal portions to facilitate tearing off of the latter.

In each of the four embodiments depicted in FIGS. 7-10, permanent seals 12 and 12' can be made by extended heated sealing bars toward a separator plate (not shown in FIGS. 7-10) disposed between the zones of joinder. Alternatively, the portions of the closure tape that are joined to web 2 by seals 12 and 12' have interior surfaces coated with non-sealant material (see layers 52 and 52' in FIG. 14) that will not be fused as a result of the heat sealing operation. In accordance with yet another alternative method of preventing sealthrough of the legs of the closure tape, a thermal barrier can be used.

While the invention has been described with reference to certain embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, welded, bonded, sealed, adhered, etc., whether by application of heat and/or pressure, application of ultrasonic energy, application of a layer of adhesive material or bonding agent, interposition of an adhesive or bonding strip, co-extrusion (e.g., of zipper and bag), etc. As used in the claims, the term "package" includes bags, pouches, and any other type of packaging (filled or empty) in which a flexible plastic closure tape can be incorporated. As used in the claims, the term "closure tape" does not include closure tapes that have interlockable or interengageable zipper or closure profiles. Further, in the absence of explicit language in any method claim setting forth the order in which certain steps should be performed, the method claims should not be construed to require that steps be performed in the order in which they are recited.

The invention claimed is:

1. A method of manufacture comprising the following steps:

(a) wrapping a portion of a web material around a vertical product fill tube;

(b) joining first and second portions of a closure tape to first and second fin portions of said web material that do not form part of said portion of said web material that is wrapped around said tube, said closure tape being rupturable and not reclosable;

(c) cross sealing said web material at a location downstream from said tube; and (d) dropping product through said tube and onto the most recently formed cross seal.

2. The method as recited in claim 1, further comprising the step of cutting said web material and said closure tape along a respective line that is generally parallel to and intersects each cross seal.

3. The method as recited in claim 1, wherein said first and second portions of said closure tape comprise first and second portions of a folded web having a centerline.

4. The method as recited in claim 3, further comprising the step of scoring said folded web along mutually parallel first and second lines that are parallel to said centerline and located equal distances from said centerline.

5. The method as recited in claim 3, further comprising the step of weakening the tear resistance of said folded web along said centerline.

6. The method as recited in claim 3, further comprising the step of joining a layer of peel seal material to said first and second portions of said folded web.

7. The method as recited in claim 3, further comprising the step of joining first and second layers of non-sealant material to said first and second portions of said folded web respectively.

8. The method as recited in claim 1, wherein said first and second portions of said closure tape comprise respective first portions of first and second webs, said closure tape further comprising a rupturable seal joined to respective second portions of said first and second webs.

9. The method as recited in claim 8, wherein said rupturable seal comprises first and second layers of material that separate when pulled apart with sufficient force.

10. The method as recited in claim 8, wherein said rupturable seal comprises a layer of peel sealable material.

11. The method as recited in claim 1, further comprising the steps of placing said first and second portions of said closure tape inside said first and second fin portions of said web material.

12. The method as recited in claim 1, further comprising the steps of placing said first and second portions of said closure tape outside said first and second fin portions of said web material.

13. A method of automatically manufacturing closed bags, comprising the following steps:

(a) intermittently advancing a web along a pathway that partly encircles a tube having an axis, whereby after each advancement, a portion of said web is wrapped around a portion of said tube, while first and second fin portions of said web extend generally radially outward from said tube;

(b) during each dwell time, joining a respective section of a closure tape to said first and second fin portions of said web while said portion of said web is wrapped around said portion of said tube, thereby forming a closure-web assembly;

(c) during each dwell time and after step (b) has been performed, cross sealing said web in a transverse region at an elevation below an outlet end of said tube;

(d) during each dwell time, dropping product down said tube and onto the most recently cross-sealed portion of said web; and (e) during each dwell time, cutting said closureweb assembly along a transverse line that intersects a respective cross-sealed region, thereby severing a finished bag from said closure-web assembly.

14. The method as recited in claim 13, further comprising the steps of placing said first and second portions of said closure tape inside said first and second fin portions of said web material.

15. The method as recited in claim 13, further comprising the steps of placing said first and second portions of said closure tape outside said first and second fin portions of said web material.

16. The method as recited in claim 13, wherein said first and second portions of said closure tape comprise first and second portions of a folded web having a centerline.

17. The method as recited in claim 16, further comprising the step of scoring said folded web along mutually parallel first and second lines that are parallel to said centerline and located equal distances from said centerline.

18. The method as recited in claim 16, further comprising the step of weakening the tear resistance of said folded web along said centerline.

19. The method as recited in claim 16, further comprising the step of joining a layer of peel seal material to said first and second fin portions of said folded web.

20. The method as recited in claim 16, further comprising the step of joining first and second layers of nonsealant material to said first and second portions of said folded web respectively.

21. The method as recited in claim 13, wherein said first and second portions of said closure tape comprise respective first portions of first and second webs, said closure tape further comprising a rupturable seal joined to respective second portions of said first and second webs.

22. The method as recited in claim 21, wherein said rupturable seal comprises first and second layers of material that separate when pulled apart with sufficient force.

23. The method as recited in claim 21, wherein said rupturable seal comprises a layer of peel sealable material.

* * * * *